United States Patent [19]

Romansky et al.

[11] Patent Number: 4,501,483

[45] Date of Patent: Feb. 26, 1985

[54] FUSER APPARATUS

[75] Inventors: John A. Romansky, Rochester; Gary R. Matson, Scottsville, both of N.Y.

[73] Assignee: Eastman Kodak Company, Rochester, N.Y.

[21] Appl. No.: 528,824

[22] Filed: Sep. 2, 1983

[51] Int. Cl.[3] ..... G03G 15/20

[52] U.S. Cl. ..... 355/3 FU; 118/60; 118/260

[58] Field of Search ..... 355/3 FU, 14 FU; 432/60; 219/216, 388; 118/260, 60

[56] References Cited

U.S. PATENT DOCUMENTS

| | | | |
|---|---|---|---|
| 3,291,466 | 12/1966 | Aser et al. | 263/6 |
| 3,718,116 | 2/1973 | Thettu | 118/266 |
| 3,841,827 | 10/1974 | Thettu | 432/60 |
| 3,883,291 | 5/1975 | Cloutier | 432/60 |
| 3,941,085 | 3/1976 | Hattler et al. | 432/60 X |
| 3,964,431 | 6/1976 | Namiki | 118/60 |
| 4,026,238 | 5/1977 | Bar-on | 118/60 |
| 4,083,322 | 4/1978 | Beckman | 118/60 X |
| 4,136,613 | 1/1979 | Namiki | 118/60 |
| 4,231,653 | 11/1980 | Nagahara et al. | 118/60 X |
| 4,280,443 | 7/1981 | Bogoshian | 118/60 |
| 4,359,963 | 11/1982 | Saito et al. | 118/60 |
| 4,375,201 | 3/1983 | Kato | 118/60 |
| 4,426,953 | 1/1984 | Kromm et al. | 118/60 |
| 4,458,625 | 7/1984 | Sakane et al. | 118/60 |

*Primary Examiner*—Richard L. Moses

*Attorney, Agent, or Firm*—Donald D. Schaper

[57] ABSTRACT

Fuser apparatus for fusing a toner image to a support moved along a path which is inclined to the horizontal transversely to the direction of movement of the support. A fuser member is mounted adjacent to the path and has a wick for applying release material which is fluid at fusing temperatures to the fuser member. The wick is inclined to the horizontal and includes discontinuities or barriers to retard migration of release material to the lower end of the wick due to the influence of gravity.

9 Claims, 6 Drawing Figures

FUSER APPARATUS

BACKGROUND OF THE INVENTION

This invention relates generally to apparatus for fusing a toner image to a support. More particularly this invention relates to fuser apparatus including a fuser member which contacts a toner image carrying support inclined to the horizontal transversely to the direction of movement of the support and further including wick means for applying to the fuser member. The wick means includes means for retarding migration of release material along said wick means due to the influence of gravity.

In electrophotography a light image of an original is projected upon a charged photoconductive member to form a latent electrostatic image corresponding to the original. A visible toner image is produced by developing the electrostatic image with charged toner particles. If the photoconductive member is reusable in the form of a belt or a drum, the toner image is then transferred to a support such as a web or sheet of plain paper and fused to the support. If the photoconductive member itself is the support then the toner image is fused directly to the photoconductive member.

One technique used to fuse a toner image to a support is through the application of heat and pressure by contacting the toner image with a heated fuser member such as a roller or belt. For example, a pair of rollers held together under pressure form a nip through which a toner image-carrying support is passed. One or both of the rollers are heated to melt the heat-softenable toner particles to fuse the toner image. In such fusers at least one of the rollers may be formed with an elastomeric layer to lengthen the nip through which the toner image passes in order to increase fusing time and to lower fusing energy requirements. Commonly used elastomers (e.g. silicone elastomer or fluoroelastomer) are those which are resistant to degradation at high temperatures over a long operating life and which have good release properties to prevent offset of toner particles to the surface of the fusing member and to obviate the tendency of a support to stick to the fuser member.

In order to enhance the release properties of the fuser a coating of release material such as silicone release oil may be applied to the fuser member by means of a wick which has a segment in contact with the effective fusing length of the member. The wick may be made of a high-temperature resistant felt such as the nylon, Nomex®. The wick may be saturated with release material which is gradually applied to the fusing surface of the fusing member over a period of time. Alternatively, the wick may be supplied with release material from a separate reservoir on a demand basis during operation of the electrographic apparatus. Since electrographic apparatus generally have a support path which is transversely horizontal to the direction of movement of a support along the path, there is no tendency due to the influence of gravity for release material to migrate laterally along the length of the wick and to build up at one end. In certain apparatus, the support path is transversely inclined to the horizontal. Thus, the KODAK STARVUE Microfilm Reader-Printer Apparatus is inclined to the horizontal for operator convenience and ease of operation. An electrographic printer used in such apparatus would also be inclined to the horizontal and have a support path transversely inclined to the horizontal. Where release material which is fluid at fusing temperatures is applied to a fuser member adjacent to such a transversely inclined path, there is a tendency due to gravity for release material to migrate laterally toward the lower end of the wick thus creating an excess of release material along the lower end of the wick and an insufficiency of release material along the upper end of the wick. This causes excess release material to be carried off by a support on one side of the sheet path and toner and/or the support to be stuck to the fuser member on the other side of the path.

Thus, it would be desirable to provide fuser apparatus for use in electrographic apparatus having a support path transversely inclined to the horizontal in which release material is evenly applied to the effective fusing length of the fusing member so as to avoid excessive application of release material at the lower end of the fusing apparatus and insufficient application of release material at the upper end of the fusing member.

SUMMARY OF THE INVENTION

According to the present invention, there is provided fuser apparatus for use in reproduction apparatus in which a support carrying an unfused toner image is moved along a path which is inclined to the horizontal transversely to the direction of movement of said support. The fuser apparatus includes a fuser member located adjacent to the support path which has a fusing surface which contacts a support moved along said path. Wick means are provided for applying release material to said fusing surface wherein the wick means is inclined to the horizontal and includes means for retarding release material from migrating along said wick means due to gravity. In a preferred embodiment of the invention, the means for retarding includes discontinuities in the wick means to retard migration of said release material beyond said discontinuities.

The invention and its features and advantages will be set forth and become more apparent in the detailed description of the preferred embodiment presented below.

BRIEF DESCRIPTION OF THE DRAWINGS

In the detailed description of the preferred embodiments of the invention presented below, reference is made to the accompanied drawings, like numbers indicating like elements in which.

DESCRIPTION OF THE PREFERRED EMBODIMENTS

Although the fuser apparatus of the present invention may be used with any type of electrographic apparatus, the fuser apparatus is particularly useful in reproduction apparatus in which the support path is transversely inclined to the horizontal such as in microfilm-reader apparatus having an electrographic print module in which the components are inclined to the horizontal.

Figure 1:
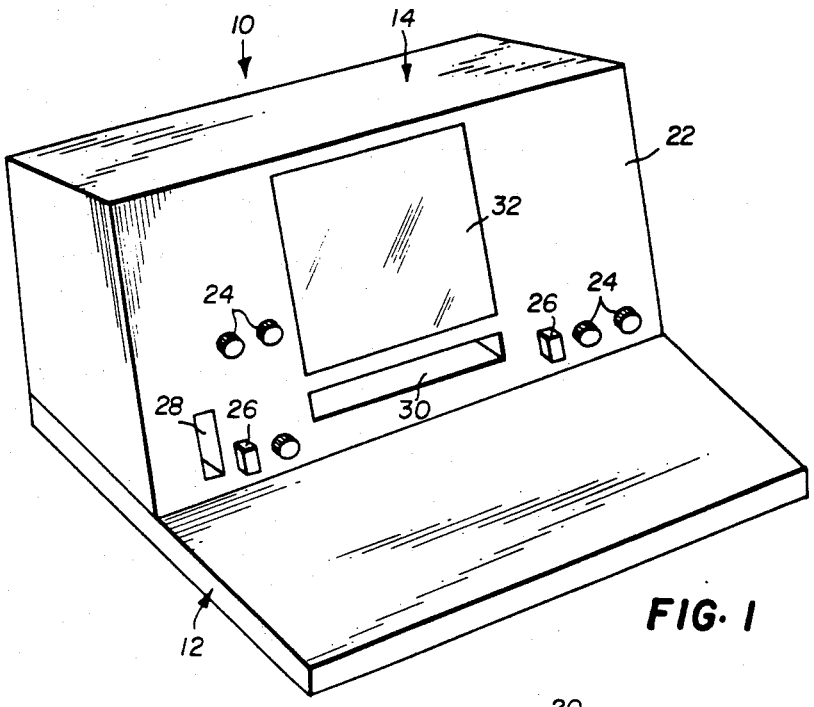
FIG. 1 is a schematic perspective view of microfilm-reader apparatus in which the fuser apparatus of the present invention may be used.

Referring now to FIG. 1, there is illustrated in perspective view microfilm-reader apparatus 10 mounted on a table 12. Apparatus 10 includes a cabinet 14 which has a microfilm projection and transport assembly 16 (FIG. 2) located in the left-hand portion thereof; an image display and print delivery assembly 18 in the central portion; and an electrographic print assembly 20 located in the right-hand portion of cabinet 14. Mounted on the front wall 22 (FIG. 1) of cabinet 14 are several control knobs 24 and buttons 26 for controlling the functions of projection and transport assembly 16 and print assembly 20. Such controls, for example, are provided for manually controlling direction and speed of film movement during viewing, for focusing images projected from the microfilm, for switching power on and off, for printing, etc. Front wall 22 also includes a film receptacle slot 28 for receiving a cartridge of microfilm; a print delivery receptacle 30 from which finished prints are removed by the operator, and a display screen 32 onto which the enlarged microfilm images are projected for viewing.

Figure 2:
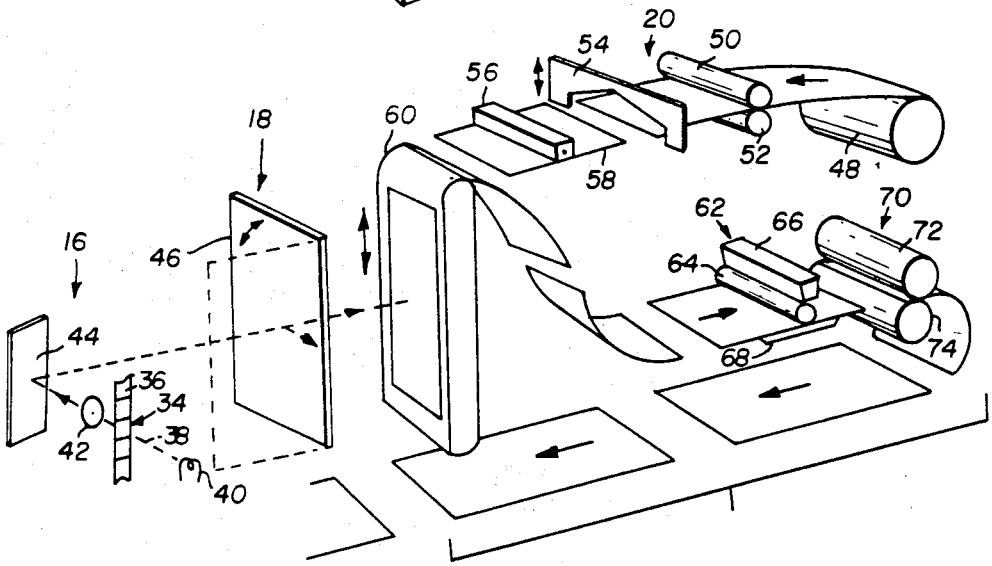
FIG. 2 is a diagrammatic perspective view of the internal assemblies of the apparatus of FIG. 1.

Referring now to FIG. 2, there is shown schematically assemblies 16, 18 and 20 of microfilm apparatus 10. As shown, microfilm 34 comprises a plurality of frames 36 which are selectively positioned to intersect light projected along axis 38 from light source 40. Film 34 is supplied from a reel or cartridge of film inserted into slot 28 and taken up by a takeup reel (not shown). The microfilm image is projected by lens 42 along axis 38 and reflected off lens mirror 44 to either be displayed upon screen 32 after reflection from screen mirror 46 (when mirror 46 is in the position shown in solid lines in FIG. 2) or to be reproduced by print assembly 20 (when mirror 46 is in the position shown in dotted lines in FIG. 2).

Print assembly 20 includes a supply of photoconductive support material in the form of a roll 48 which is convenient for providing prints of differing lengths depending upon the size of the image recorded on microfilm 34. It will be understood that a supply of pre-cut sheets of photoconductive material may be provided either in addition to or in lieu of roll 48.

Metering rollers 50 and 52 meter out a preselected length of photoconductive material which is severed from roll 48 by means of knife 54 which reciprocates up and down.

The cut sheet 58 then passes under corona charger 56 which deposits an electrostatic charge thereon. Sheet 58 is transported onto vacuum platen 60 which positions the paper for exposure to a radiation image directed along axis 38 from microfilm 34, thus forming a latent electrostatic image corresponding to the microfilm image.

Vacuum belt 60 is then reversed and sheet 58 is moved rearwardly and downwardly to development station 62 which includes magnetic brush 64, toner supply 66 and conductive plate 68. Magnetic brush 64 receives toner particles from supply 66 and deposits them on the latent electrostatic image on copy sheet 58 to develop the image into a visible image of the microfilm image. Either negative-to-positive or positive-to-positive prints may be made. When negative-to-positive prints are made, the development station is biased to the charge level of the latent electrostatic image whereas when positive-to-positive prints are made, the development station is biased to ground. Sheet 58 carrying an unfused toner image is transported to fuser apparatus 70 which includes heated fuser member or roller 72 and pressure roller 74 held in pressure engagement to permanently fix the toner image to sheet 58.

Thereafter, the finished print is delivered to receptacle 30 for removal by the operator.

It will be appreciated that the components of microfilm-reader apparatus 10 of FIG. 2 are schematically illustrated only. Distances between components of printer assembly 20 are shown farther apart than in actual practice in order to more clearly illustrate the interrelationship of the several components. It will also be appreciated that apparatus 10 of FIG. 2 is oriented to fit into cabinet 14 of FIG. 1 so that the copy sheet path in print assembly 20 is transversely inclined to the horizontal at an angle of about 20°.

Figure 3:
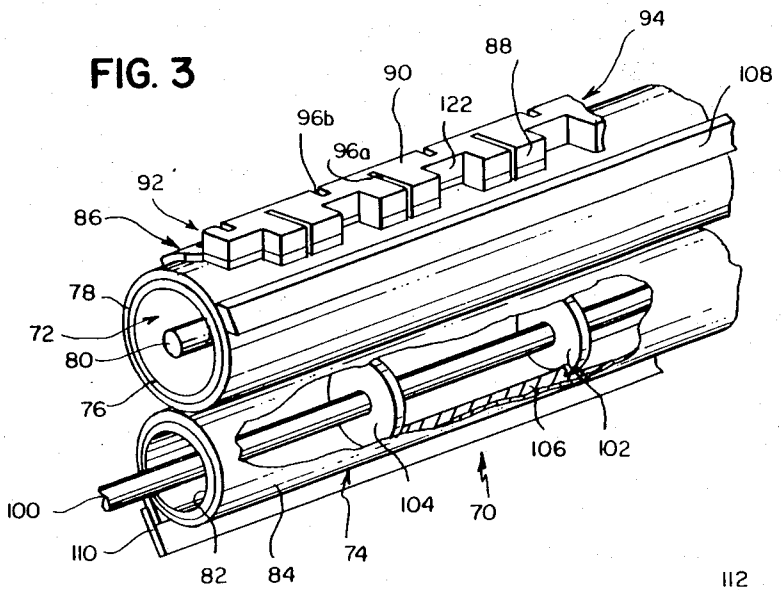
FIG. 3 is a partially sectional perspective view of one embodiment of fuser apparatus according to the present invention.

Referring now to FIG. 3, there is shown in greater detail fuser apparatus 70. As shown, fuser roller 72 includes a cylindrical core 76 of heat conductive material such as aluminum having a layer 78 of high-temperature resistant elastomer such as silicone elastomer which has good release properties. Positioned within roller 72 is a source of heat such as quartz lamp 80. Pressure roller 74 is in pressure contact with fuser roller 72 and includes a cylindrical core 82 having a layer 84 of material such as polytetrafluoroethylene which also has good release properties. Rollers 72 and 74 have longitudinal axes which are inclined to the horizontal at an angle of 10° because of the orientation of print assembly 20 within cabinet 14. This causes the path of a support such as a copy sheet to be inclined to the horizontal by an angle of 20° transversely to the direction of movement of the copy sheet since cabinet 14 is inclined another 1O° when mounted on table 12.

In order to improve the efficiency of fuser apparatus 70 in preventing toner from fused copy sheets to offset to rollers 72 and 74 and in eliminating copy sheet wraparound, wick means such as applicator 86 for release material is provided in contact with fuser roller 72. Applicator 86 comprises a porous material such as high-temperature resistant nylon felt and is saturated with release material such as silicone fuser oil which is fluid at fusing temperatures. Applicator 86 is dimensioned to apply release material to the effective fusing length of fuser roller 72 about its periphery so as to form a substantially uniform coating on the fusing surface of roller 72. Applicator 86 includes a first segment 88 and a second segment 90. Segment 90 contacts fuser roller 72 and applies release material to the fusing surface of roller 72. Segment 88 is thicker than segment 90 and serves as a reservoir for a substantial amount of release material which is gradually dissipated through segment 90 during operation of print assembly 20 as fused sheets carry off minute quantities of release material.

Due to the inclined orientation of fuser roller 72, applicator 86 is also inclined to the horizontal transverse to the copy sheet path. This results in a tendency for release material to migrate along applicator 86 due to gravity so that an excess of release material would build up at the lower end 92 of applicator 86 and a deficiency of release material would occur at the upper end 94 of applicator 86. If this tendency were not compensated for, a copy sheet carrying a toner image passed through the nip of rollers 72 and 74 would either tend to absorb too much release material or to stick to roller 72. According to the present invention, applicator 86 contacting roller 72 is provided with means for retarding release material from migrating along applicator 86 due to the influence of gravity. In the embodiment shown in FIG. 3, applicator 86 includes a plurality of discontinuities such as spaced slits 96*a* and 96*b* which are cut through segments 88 and 90 to retard release material from migrating past slits 96*a*, 96*b* thus resulting in more even application of release material to fuser roller 72 and minimizing buildup at the lower end of wick 86.

Applicator 86 has notches 122 to receive copy sheet stripper members (not shown). Slits 96*b* extend through segments 88 and 90 and stop short of edge 98 of applicator 86 to provide uninterrupted application of oil along the length of roller 72. Slits 96*a* are provided between notches 122 with an overlap between the ends of adjacent slits 96*a* and 96*b*.

Figure 4:
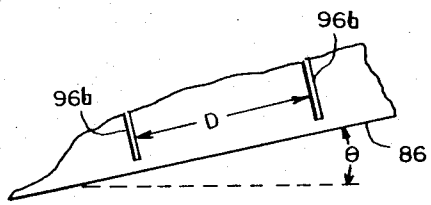
FIG. 4 is a diagrammatic view of a segment of the wick means of FIG. 3.

As seen more clearly in FIG. 4, the spacing D between slits 96*b* is related to the angle $\theta$ at which applicator 86 is inclined to the horizontal and to the porosity of the material used in applicator 86. For an angle of $\theta=20°$ and applicator material of high temperature resistant nylon felt such as Nomex®, a spacing D of about 2.5 inches (6.3 cm.) has been found satisfactory to minimize depletion of oil in the portions of applicator 86 between slits due to the capillary action of the porous material of applicator 86.

It will be understood that other forms of discontinuities may be provided in applicator 86 to retard migration of release material. Thus, in lieu of slits 96*a*, 96*b*, the retarding means can take the form of laterally disposed barriers of material which are less porous than the rest of the applicator material to retard migration. For example, if applicator 86 were made of a porous-woven material, laterally disposed non-absorbent fibers could be woven into the material to form absorbent regions for absorbing release material separated by non-absorbent barriers.

As shown in FIG. 3, pressure roller 74 is mounted on a shaft 100 by means of bearings 102 and 104 which contact a centrally disposed thickened segment 106 of core 82. Bearings 102 and 104 are mounted internally of pressure roller 74 in order to maintain a more uniform pressure along the nip formed by rollers 72 and 74. The thickness of shell 82 is preferably such as to allow the ends of roller 74 to flex when it engages roller 72 to effect more uniform pressure along the roller nip length.

Fuser apparatus 72 also includes wiper 108 for cleaning fuser roller 72 of any unfused toner that may have adhered to the roller during the fusing operation. A wiper 110 contacts pressure roller 74 to clean any unfused toner which may have adhered to it.

Figure 6:
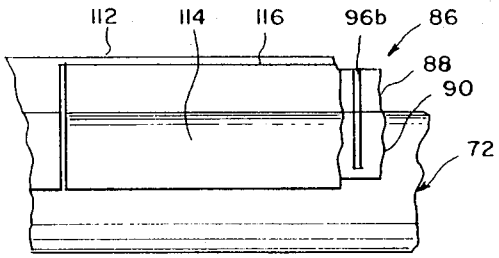
FIGS. 5 and 6 are partial side elevational and front elevational views of a modified fuser apparatus according to the present invention.
Figure 5:
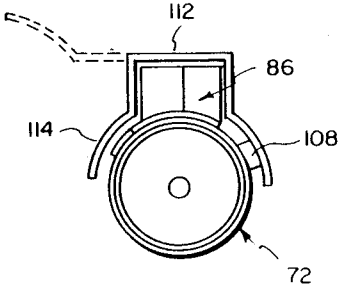

Referring now to FIGS. 5 and 6, there is shown another form of fuser apparatus 70 in which a generally U-shaped member 112 is provided to support wick 86 and to minimize heat from fuser roller 72 from escaping into the environment to overheat other components of print assembly 20. Member 112 includes a segment 114 hinged at 116 to permit access to the fuser nip to clear paper jams. Segment 114 is movable between a closed position as shown in solid lines in FIG. 5 and an open position as shown in dashed lines in FIG. 5.

The invention has been described in detail with particular reference to the preferred embodiments thereof but it will be understood that variations and modifications can be effected within the spirit and scope of the invention.

What is claimed is:

1. In reproduction apparatus in which a support carrying an unfused toner image is moved along a path which is inclined to the horizontal transversely to the direction of movement of said support, fuser apparatus comprising:

a fuser member located adjacent to said path and having a fusing surface which contacts a support moved along the path; and wick means at least partially overlying said fusing surface for applying release material which is fluid at fusing temperatures to said fusing surface, said wick means being inclined to the horizontal and including means for retarding release material from migrating along said wick means due to gravity.

2. The fuser apparatus of claim 1 wherein said retarding means includes means defining laterally disposed discontinuities in said wick means to retard migration of said release material beyond said discontinuities.

3. The fuser apparatus of claim 2 wherein said wick means includes a segment contacting said fusing surface of said fuser member and wherein said segment includes said means for defining discontinuities.

4. The fuser apparatus of claim 3 wherein said means for defining includes at least one slit in said wick means.

5. Fuser apparatus comprising:

a fuser roller having an axis of rotation inclined to the horizontal; and wick means disposed adjacent to said fuser roller for applying release material which is fluid at fusing temperatures to said fuser roller, said wick means including means for retarding release material from migrating along said wick means due to gravity.

6. The fuser apparatus of claim 5 wherein said retarding means includes means for defining at least one laterally disposed discontinuity to retard lateral migration of release material due to gravity beyond said discontinuity.

7. The fuser apparatus of claim 6 wherein said defining means includes at least one laterally disposed slit in said wick means.

8. The fuser apparatus of claim 6 wherein said wick means is of porous material and said defining means includes a plurality of spaced laterally disposed slits in said wick means, the spacing between said slits being a function of the angle said wick means is inclined to the horizontal and the capillarity of said porous material so that said wick means remains saturated.

9. The fuser apparatus of claim 5 including a U-shaped member for supporting said wick means, said member partially surrounding said fuser roller for conserving heat, said member having a hinged segment for permitting access to said wick and said fuser roller.

* * * * *